US011159904B2

(12) United States Patent
Ma

(10) Patent No.: US 11,159,904 B2
(45) Date of Patent: Oct. 26, 2021

(54) DOME MATERIAL, DIAPHRAGM AND SPEAKER

(71) Applicant: AAC Technologies Pte. Ltd., Singapore (SG)

(72) Inventor: Lipeng Ma, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/705,162

(22) Filed: Dec. 5, 2019

(65) Prior Publication Data

US 2020/0213795 A1 Jul. 2, 2020

(30) Foreign Application Priority Data

Dec. 29, 2018 (CN) ..... 201811637249.8

(51) Int. Cl.
*H04R 31/00* (2006.01)
*H04R 7/12* (2006.01)

(52) U.S. Cl.
CPC ..... *H04R 31/003* (2013.01); *H04R 7/122* (2013.01); *H04R 7/127* (2013.01); *H04R 2307/023* (2013.01); *H04R 2307/025* (2013.01)

(58) Field of Classification Search
CPC ..... H04R 7/122; H04R 7/127; H04R 31/003; H04R 2307/023; H04R 2307/025
See application file for complete search history.

(56) References Cited

U.S. PATENT DOCUMENTS

2010/0288579 A1* 11/2010 Gerkinsmeyer ..... H04R 7/10 181/169
2015/0125692 A1* 5/2015 Mussig ..... B29C 51/14 428/339
2016/0052246 A1* 2/2016 Egger ..... C09J 7/25 381/426
2018/0302720 A1* 10/2018 Di ..... B32B 5/245

* cited by examiner

*Primary Examiner* — Sunita Joshi
(74) *Attorney, Agent, or Firm* — W&G Law Group

(57) ABSTRACT

A dome material, a diaphragm and a speaker are provided. The speaker includes the diaphragm made of the dome material. The dome material includes an intermediate layer, an adhesive layer, a film layer, and a surface layer. The adhesive layer, the film layer, and the surface layer are sequentially stacked on the intermediate layer in a direction away from the intermediate layer. The intermediate layer is formed by a foamed material. A thickness of the adhesive layer is 3-20 μm. The film layer is adhered to the intermediate layer via the adhesive layer. A thickness of the film layer is 2-20 μm. The surface layer adopts fiber prepreg including fiber and resin, the fiber is unidirectionally arranged, and a weight percentage of the fiber is 20%-50%. A surface density of the fiber prepreg is 10-100 g/m$^2$.

17 Claims, 1 Drawing Sheet

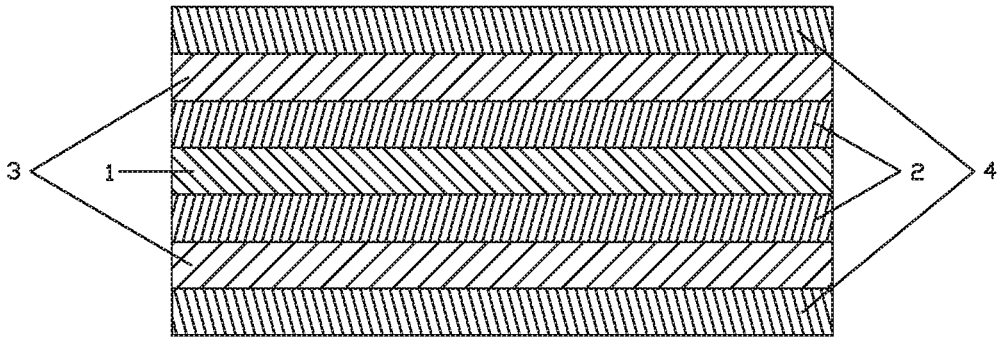
3
1
2
4

DOME MATERIAL, DIAPHRAGM AND SPEAKER

TECHNICAL FIELD

The present disclosure relates to the technical field of speakers, and in particular, to a dome material, a diaphragm and a speaker.

BACKGROUND

With advent of a mobile internet era, numerous smart mobile devices continuously emerge. Among these numerous mobile devices, mobile phones are undoubtedly the most common and portable mobile terminal devices. At present, mobile phones have extremely various functions, one of which is high-quality music displaying. Hence, a speaker box for playing sound is widely used in today's smart mobile devices.

The existing speakers usually use diaphragm to vibrate and to sound, and a high frequency cut-off frequency thereof is an important parameter for evaluating the diaphragm. In the related art, the diaphragm usually includes a diaphragm body and a dome attached to a central position of the diaphragm, and the dome usually has a sandwich structure composed an aluminum foil, polymethacrylimide foam plastic (PMI), and aluminum foil. However, the aluminum foil dome with such a sandwich structure usually has a high-frequency cut-off frequency smaller than 8.5 KHz, which can not meet the requirements on the high-pitched acoustic performance of the speaker.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

FIG. 1 is a structural schematic diagram of a dome material according to an embodiment of the present disclosure.

REFERENCE SIGNS

1 intermediate layer;
2 adhesive layer;
3 film layer;
4 surface layer.

DESCRIPTION OF EMBODIMENTS

The present disclosure will be further described in detail in the following with reference to the accompanying drawings and embodiments. It is understood that the specific embodiments described herein are merely illustrative of the present disclosure and are not intended to limit the present disclosure.

Embodiment

In this embodiment, the speaker includes a diaphragm, and the diaphragm is formed by cutting a dome material. As shown in FIG. 1, the dome material includes: an intermediate layer 1, adhesive layers 2, film layers 3, and surface layers 4. One adhesive layer 2, one film layer 3 and one surface layer 4 are sequentially stacked on the intermediate layer 1. Moreover, the adhesive layer 2, the film layer 3 and the surface layer 4 are stacked on two sides of the intermediate layer 1. The intermediate layer 1 is made of a foamed material. A density of the foamed material is in a range of 0.05-0.50 g/cm$^3$. A thickness of the adhesive layer 2 is in a range of 3-20 μm. The film layer 3 is adhered to the intermediate layer 1 via the adhesive layer 2, and a thickness of the thin film layer 3 is in a range of 2-20 μm. The surface layer 4 is formed by unidirectional arrangement of fiber prepreg. The fiber prepreg includes fiber and resin, and a weight percent of the resin is in a range of 20%-50%. A surface density of the fiber prepreg is in a range of 10-100 g/m$^2$.

The intermediate layer 1 of the dome material is made of a foamed material. The adhesive layer 2, the film layer 3 and the surface layer 4 are stacked, from the center to the outside, on each of two sides of the intermediate layer 1. The surface layer 4 adopts a fiber prepreg, which can improve a quality of the dome material. With the diaphragm and the speaker formed by the dome material according to the present embodiment of the present disclosure, the high frequency cut-off frequency can be increased to 10 KHz, thereby meeting people's requirements on the high-pitched acoustic performance of the speaker.

In this embodiment, the foamed material is a rigid foamed material, and for example, has a density of 0.05 g/cm$^3$, 0.10 g/cm$^3$, 0.15 g/cm$^3$, 0.20 g/cm$^3$, 0.25 g/cm$^3$, 0.30 g/cm$^3$, 0.35 g/cm$^3$, 0.40 g/cm$^3$, 0.45 g/cm$^3$, 0.50 g/cm$^3$, etc. The intermediate layer 1 can include a material selected from the group consisting of polymethacrylimide (PMI) foamed plastic, Micro Cellular PET (MCPET), polyimide (PI), polyamideimide (PAI) and phenylene sulfide (PPS), and combinations thereof. In other embodiments, the intermediate layer can also include a material selected from the group consisting of polystyrene, rigid polyurethane, phenolic resin, amino resin, epoxy resin, rigid polyvinyl chloride, and combinations thereof.

The thickness of the adhesive layer 2 can be in a range of 5-15 μm, for example, 5 μm, 6 μm, 7 μm, 8 μm, 9 μm, 10 μm, 11 μm, 12 μm, 13 μm, 14 μm, 15 μm, etc. The thickness of the adhesive layer 2 can also be in a range of 3-5 μm, for example, 3 μm, 4 μm, 5 μm, etc. The thickness of the adhesive layer 2 can also be in a range of 15-20 μm, for example, 16 μm, 17 μm, 18 μm, 19 μm, 20 μm, etc. The adhesive layer 2 is formed by an adhesive. In this embodiment, the adhesive is selected from the group consisting of epoxy resin, phenolic resin, acrylic resin, silica gel, and combinations thereof. The adhesive is used for bonding and fixing the intermediate layer 1 with the film layer 3, and thus it can be any material capable of bonding and fixing intermediate layer 1 with the film layer 3. For example, in other embodiments, the adhesive can be, for example, selected from the group consisting of cellulose ester, vinyl polymer, polyether, polyamide, phenolic aldehyde-butyronitrile adhesive, phenolic aldehyde-neoprene adhesive, phenolic aldehyde-polyurethane adhesive, epoxy-butyronitrile adhesive, epoxy-polysulfide, and combinations thereof.

The thickness of the film layer 3 can be in a range of 5-15 μm, for example: 5 μm, 6 μm, 7 μm, 8 μm, 9 μm, 10 μm, 11 μm, 12 μm, 13 μm, 14 μm, 15 μm, etc. The thickness of the film layer 3 can also be in a range of 2-5 μm, for example, 2 μm, 3 μm, 4 μm, 5 μm, etc. The thickness of the film layer 3 can also be in a range of 15-20 μm, for example, 16 μm, 17 μm, 18 μm, 19 μm, 20 μm, etc. In the present embodiment, the film layer 3 is made of a high modulus material, and the film layer 3 includes a material selected from the group consisting of aluminum foil, magnesium lithium alloy foil, titanium foil, polyimide (PI), liquid crystal polymer (LCP), polyethylene terephthalate (PET), polyethylene naphthalate (PEN), and combinations thereof. In other embodiments, the film layer 3 can also include a material selected from the group consisting of lithium aluminum alloy foil, magnesium aluminum alloy foil, polyphenylene ether (PPE), and combinations thereof.

In the fiber prepreg of the surface layer 4, the weight percentage of the resin can be, for example, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, etc.. The surface density of the fiber prepreg can be, for example, 10 $g/m^2$, 15 $g/m^2$, 20 $g/m^2$, 25 $g/m^2$, 30 $g/m^2$, 35 $g/m^2$, 40 $g/m^2$, 45 $g/m^2$, 50 $g/m^2$, 55 $g/m^2$, 60 $g/m^2$, 65 $g/m^2$, 70 $g/m^2$, 75 $g/m^2$, 80 $g/m^2$, 85 $g/m^2$, 90 $g/m^2$, 95 $g/m^2$, 100 $g/m^2$, etc.. In the present embodiment, the resin can be selected from the group consisting of epoxy resin, phenolic resin, polyamide resin, polyetheretherketone (PEEK), polyimide (PI), polyetherimide (PEI), and combinations thereof. In other embodiments, the resin can also be selected from the group consisting of polypropylene (PP), polycarbonate (PC), polyether sulfone (PES), and combinations thereof. In this embodiment, the fiber is selected from the group consisting of carbon fiber, glass fiber, aramid fiber, basalt fiber, and combinations thereof. For example, the fiber is selected from the group consisting of polyacrylonitrile-based carbon fiber, pitch-based carbon fiber, poly-p-phenylene benzobisthiazole fiber (PBO fiber), poly-p-phenylene terephthalamide, PE fiber, AR glass fiber, high-strength glass fiber, E-glass fiber, and combinations thereof.

The above described embodiments are merely intended to illustrate the present disclosure, and it should be noted that, without departing from the inventive concept of the present disclosure, the improvements made by those skilled in the related art shall fall within the protection scope of the present disclosure.

What is claimed is:

1. A dome material, comprising:

an intermediate layer;

an adhesive layer;

a film layer; and a surface layer, wherein the adhesive layer, the film layer, and the surface layer are sequentially stacked on each of two sides of the intermediate layer; the surface layer is disposed on outermost of the dome material, the intermediate layer is made of a foamed material, and the foamed material has a density in a range of 0.05 $g/cm^3$-0.50 $g/cm^3$; the adhesive layer has a thickness in a range of 3 μm-20 μm; the film layer is adhered to the intermediate layer via the adhesive layer; the film layer has a thickness in a range of 2 μm-20 μm, and the surface layer is formed by unidirectional arrangement of fiber prepreg, the fiber prepreg comprises a fiber and a resin, and a weight percentage of the fiber in the fiber prepreg is in a range of 20%-50%; and a surface density of the fiber prepreg is in a range of 10 $g/m^2$-100 $g/m^2$.

2. The dome material as described in claim 1, wherein the intermediate layer comprises a material selected from the group consisting of PMI, MCPET, PI, PAI, PPS, and combinations thereof.

3. The dome material as described in claim 1, wherein the thickness of the adhesive layer is in a range of 5 μm-15 μm.

4. The dome material as described in claim 3, wherein the adhesive layer is formed by an adhesive, and the adhesive is selected from the group consisting of epoxy resin, phenolic resin, acrylic resin, silica gel, and combinations thereof.

5. The dome material as described in claim 4, wherein the thickness of the film layer is in a range of 5 μm-15 μm.

6. The dome material as described in claim 5, wherein the film layer comprises a material selected from the group consisting of an aluminum foil, a magnesium lithium alloy foil, a titanium foil, PI, LCP, PET, PEN, and combinations thereof.

7. The dome material as described in claim 1, wherein the resin comprises a material selected from the group consisting of epoxy resin, phenolic resin, polyamide resin, PEEK, PI, PEI, and combinations thereof.

8. The dome material as described in claim 5, wherein the fiber is selected from the group consisting of carbon fiber, glass fiber, aramid fiber, basalt fiber, and combinations thereof.

9. A diaphragm, the diaphragm being formed by cutting the dome material as described in claim 1.

10. A diaphragm, the diaphragm being formed by cutting the dome material as described in claim 2.

11. A diaphragm, the diaphragm being formed by cutting the dome material as described in claim 3.

12. A diaphragm, the diaphragm being formed by cutting the dome material as described in claim 4.

13. A diaphragm, the diaphragm being formed by cutting the dome material as described in claim 5.

14. A diaphragm, the diaphragm being formed by cutting the dome material as described in claim 6.

15. A diaphragm, the diaphragm being formed by cutting the dome material as described in claim 7.

16. A diaphragm, the diaphragm being formed by cutting the dome material as described in claim 8.

17. A speaker, comprising the diaphragm as described in claim 9.

* * * * *